US008585440B2

(12) United States Patent
Jiang et al.

(10) Patent No.: US 8,585,440 B2
(45) Date of Patent: Nov. 19, 2013

(54) HIGH-SPEED CONNECTOR WITH CONDUCTIVE PLASTIC BLOCKS IN CONTACT WITH CONTACT SECTIONS OF SIGNAL TERMINALS

(75) Inventors: Fu'an Jiang, Shenzhen (CN); Lei Liao, Shenzhen (CN); Danren He, Shenzhen (CN)

(73) Assignee: Amphenol East Asia Electronic Technology (Shenzhen) Ltd., Shenzhen, Guangdong Province (CN)

( * ) Notice: Subject to any disclaimer, the term of this patent is extended or adjusted under 35 U.S.C. 154(b) by 29 days.

(21) Appl. No.: 13/444,829

(22) Filed: Apr. 11, 2012

(65) Prior Publication Data

US 2013/0273778 A1 Oct. 17, 2013

(51) Int. Cl.
*H01R 24/00* (2011.01)

(52) U.S. Cl.
USPC ..... 439/626

(58) Field of Classification Search
USPC ..... 439/626, 79, 883
See application file for complete search history.

(56) References Cited

U.S. PATENT DOCUMENTS

| | | | | |
|---|---|---|---|---|
| 5,882,214 | A * | 3/1999 | Hillbish et al. | 439/79 |
| 6,041,498 | A * | 3/2000 | Hillbish et al. | 29/883 |
| 7,601,031 | B2 * | 10/2009 | Tanaka et al. | 439/626 |
| 8,292,654 | B2 * | 10/2012 | Yasui | 439/378 |
| 2008/0171473 | A1 * | 7/2008 | Tanaka et al. | 439/626 |
| 2013/0130556 | A1 * | 5/2013 | Blakborn et al. | 439/626 |

* cited by examiner

*Primary Examiner* — Chandrika Prasad
(74) *Attorney, Agent, or Firm* — Leong C. Lei

(57) ABSTRACT

The connector has an insulating base, a plurality of terminals, and at least two conductive plastic blocks. The insulating base has a tongue plate configured with at least an indentation. The terminals contains a first signal terminal set, a second signal terminal set, and a power terminal set configured on the tongue plate. The terminals are either positive or negative terminals, and each terminal has a contact section. The contact sections of the first signal terminal set are configured at a distance above the indentation. The conductive plastic blocks are in contact with the contact sections of the negative terminals of the first and second signal terminal sets, respectively. The distance provides additional contact area with the air so that the electrical property is improved and higher transmission speed is achieved. The shielding effect of the conductive plastic blocks reduces cross interference between adjacent terminals.

2 Claims, 1 Drawing Sheet

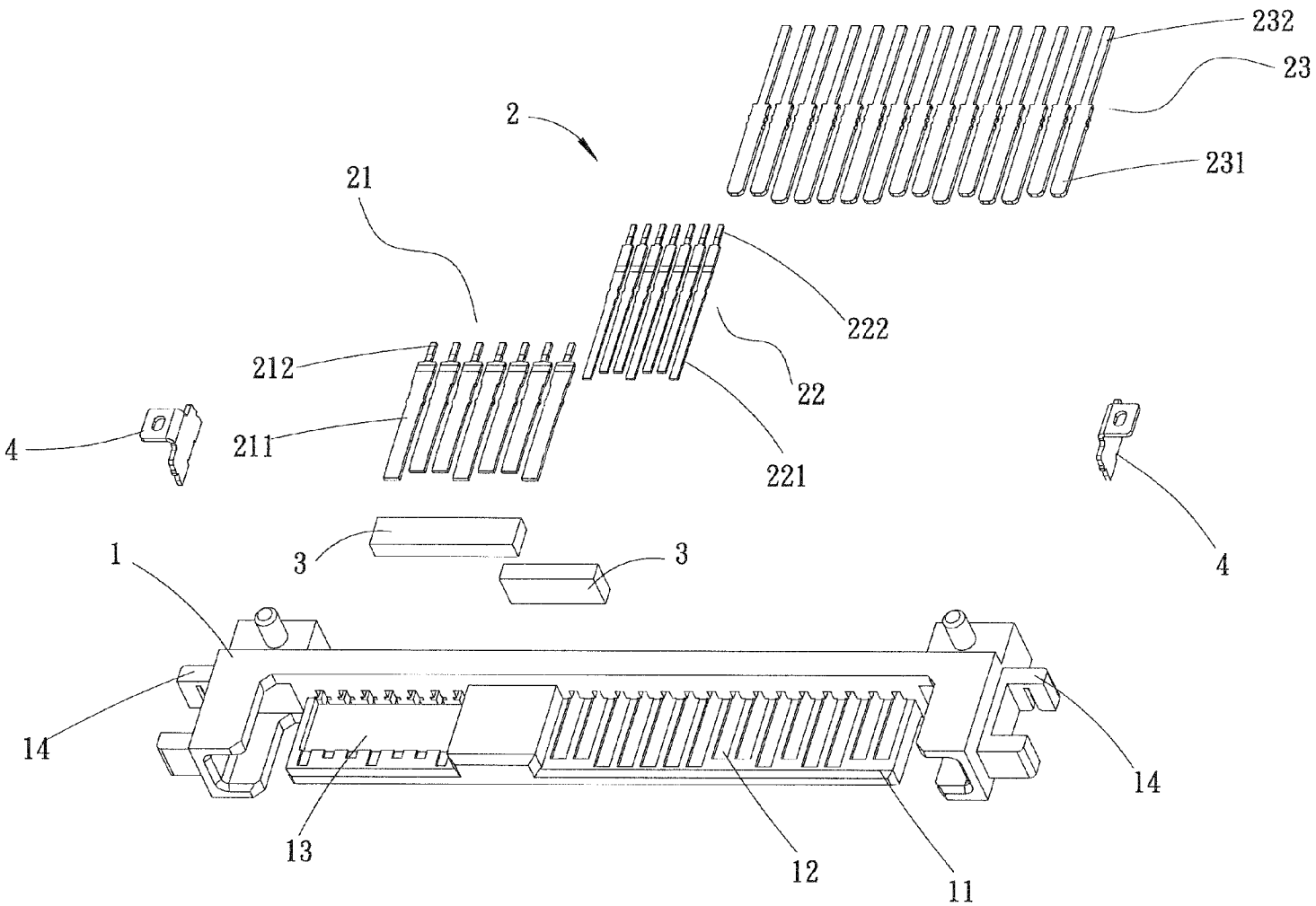
232
23
231
4
14
11
222
22
221
12
3
2
21
212
211
3
13
1
4
14

HIGH-SPEED CONNECTOR WITH CONDUCTIVE PLASTIC BLOCKS IN CONTACT WITH CONTACT SECTIONS OF SIGNAL TERMINALS

(a) TECHNICAL FIELD OF THE INVENTION

The present invention is generally related to connectors, and more particular to a high-speed connector whose terminals are configured at a distance from the connector's base and whose terminals are contacted with conductive plastic blocks for better shielding.

(b) DESCRIPTION OF THE PRIOR ART

Various electronic appliances have played important roles in people's daily life and work, and these appliances usually require different kinds of connectors for data and signal exchange.

As demands for even faster computing and communications, we are now in a high-speed transmission era where the transmission speed greater than 5 Gb/s or 10 Gb/s is not uncommon. The high-speed transmission requirement has presented new challenges to the connectors. Conventionally, connectors for high-speed transmission require greater terminal dimension or transmission path length so as to be compatible to the standard 100 ohm impedance. However, the increased terminal dimension or transmission path length leads to greater cost and bulky connector size. Another issue that needs to be considered is that the cross interference between terminals would compromise transmission integrity, thereby adversely affecting the transmission speed.

SUMMARY OF THE INVENTION

Therefore, a major objective of the present invention is to provide a high-speed connector having an insulating base, a plurality of terminals, and at least two conductive plastic blocks. The insulating base has a tongue plate configured with at least an indentation. The terminals contains a first signal terminal set, a second signal terminal set, and a power terminal set configured on the tongue plate. The terminals are either positive or negative terminals, and each terminal has a contact section. The contact sections of the first signal terminal set are configured at a distance above a bottom side of the indentation. The conductive plastic blocks are in contact with the contact sections of the negative terminals of the first and second signal terminal sets, respectively. The gap between the contact sections of the first signal terminal set and the bottom side of the indentation provides additional contact area with the air and thereby the electrical property of the first signal terminal set is improved and higher transmission speed is achieved. Additionally, with shielding effect of the conductive plastic blocks, the cross interference between adjacent terminals is reduced, again achieving higher transmission speed.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 1 is a perspective break-down diagram showing the various components of a high-speed connector according to an embodiment of the present invention.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIG. 1, a high-speed connector according to an embodiment of the present invention contains an insulating base 1, a number of terminals 2, and at least two conductive plastic blocks 3.

The insulating base 1 contains a tongue plate 11 having a number of grooves 12 and at least an indentation 13. Corresponding to each lateral end of the tongue plate 11, the insulating base 1 has a holder 14 for the configuration of a soldering piece 4. With the soldering pieces 4, the insulating base 1 can be affixed on a circuit board.

The terminals 2 are configured on the tongue plate 11 of the insulating base 1. The terminals 2 contains a first signal terminal set 21, a second signal terminal set 22, and a power terminal set 23. The terminals of the first signal terminal set 21 are either positive or negative terminals, and each terminal of the set has a contact section 211 and a soldering section 212. The contact sections 211 of the first signal terminal set 21 are configured at a distance above the bottom side of the indentation 13. The soldering sections 212 are extended outside of the insulating base 1. The terminals of the second signal terminal set 22 are also either positive or negative terminals, and each terminal of the set has a contact section 221 and a soldering section 222. The contact sections 221 of the second signal terminal set 2 are configured in the grooves 12 of the insulating base 1, respectively. The soldering sections 222 are extended outside of the insulating base 1. Each terminal of the power terminal set 23 has a contact section 231 and a soldering section 232. The contact sections 231 are configured in the grooves 12 of the insulating base 1. The soldering sections 232 are extended outside of the insulating base 1.

One of the conductive plastic blocks 3 is in touch with the contact sections 211 of the negative terminals of the first signal terminal set 21. The other conductive block 3 is in touch with the contact sections 221 of the negative terminals of the second signal terminal set 22.

According to a specific embodiment, the first and second signal terminal sets 21 and 22 have 7 terminals. The 1st, 4th, and 7th terminals are negative terminals whereas the other terminals are positive terminals. The power terminal set 23 has 15 terminals. The contact sections 211 of the positive and negative terminals of the first signal terminal set 21 are configured above the indentation 13, forming a gap from the bottom side of the indentation 13. The contact sections 211 of the negative terminals of the first signal terminal set 21 are in contact with one of the conductive plastic block 3. The contact sections 221 of the positive and negative terminals of the second signal terminal set 22 are configured in the groves 12 of the insulating base 1. In addition, the contact sections 221 of the negative terminals of the second signal terminal set 22 are in contact with the other conductive plastic block 3. The contact sections 231 of the positive and negative terminals of the power terminal set 23 are also configured in the grooves 12 of the insulating base 1.

The gap between the contact sections 211 of the first signal terminal set 21 and the bottom side of the indentation 13 provides additional contact area with the air and, by the air's low dielectric constant, the impedance and thereby the electrical property of the first signal terminal set 21 are improved and better matched with the standard 100 ohm impedance, achieving higher transmission speed. Additionally, with the conductive plastic blocks 3's contacting the contact sections 211 and 221 of the negative terminals of the first and second signal terminal sets 21 and 22, all grounded terminals of the high-speed connector of the present invention are connected together, thereby altering the electromagnetic property of where high-speed signal transmission takes place (i.e., the first and second signal terminal sets 21 and 22). Through the shielding effect of the conductive plastic blocks 3, the cross interference between adjacent terminals is reduced, again achieving higher transmission speed.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A high-speed connector, comprising:

an insulating base having a tongue plate configured with a plurality of grooves and at least an indentation;

a plurality of terminals configured on the tongue plate of the insulating base where the terminals contains a first signal terminal set, a second signal terminal set, and a power terminal set; the terminals of the first and second signal terminal sets and of the power terminal set are either positive or negative terminals; each terminal has a contact section and a soldering section extended outside of the insulating base; the contact sections of the first signal terminal set are configured at a distance above a bottom side of the indentation; and the contact sections of the second signal terminal set and the power terminal set are configured in the grooves of the insulating base; and at least two conductive plastic blocks where one of the conductive plastic block is in contact with the contact sections of the negative terminals of the first signal terminal set; and the other conductive plastic block is in contact with the contact sections of the negative terminals of the second signal terminal set.

2. The high-speed connector according to claim 1, wherein the insulating base has a holder located correspondingly to each lateral end of the tongue plate; and each holder is configured with a soldering piece.

* * * * *